US008019246B2

(12) United States Patent
Yamada

(10) Patent No.: US 8,019,246 B2
(45) Date of Patent: Sep. 13, 2011

(54) IMAGE FORMING APPARATUS

(75) Inventor: Toshiyuki Yamada, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 551 days.

(21) Appl. No.: 11/943,939

(22) Filed: Nov. 21, 2007

(65) Prior Publication Data

US 2008/0118259 A1 May 22, 2008

(30) Foreign Application Priority Data

Nov. 22, 2006 (JP) ..... 2006-316369

(51) Int. Cl.
*G03G 15/16* (2006.01)

(52) U.S. Cl. ..... 399/66; 399/308; 399/314

(58) Field of Classification Search ..... 399/66, 399/97, 101, 121, 302, 308, 310, 313, 314
See application file for complete search history.

(56) References Cited

U.S. PATENT DOCUMENTS

| | | | | |
|---|---|---|---|---|
| 5,450,180 | A | 9/1995 | Ohzeki et al. | |
| 5,999,760 | A * | 12/1999 | Suzuki et al. | 399/45 |
| 6,282,386 | B1 * | 8/2001 | Ishii | 399/66 |
| 6,498,907 | B2 * | 12/2002 | Yoda | 399/44 |
| 7,088,933 | B2 | 8/2006 | Kitajima | |
| 7,233,750 | B2 | 6/2007 | Kitajima | |
| 7,340,191 | B2 | 3/2008 | Yamada | |
| 2007/0002291 | A1 | 1/2007 | Yamada | |
| 2007/0048001 | A1 | 3/2007 | Yamada | |
| 2007/0297824 | A1 | 12/2007 | Yamada | |

FOREIGN PATENT DOCUMENTS

| | | | |
|---|---|---|---|
| JP | 2-123385 | A | 5/1990 |
| JP | 11-174871 | A | 7/1999 |
| JP | 2004-117920 | A | 4/2004 |
| JP | 2005-3999 | A | 1/2005 |

* cited by examiner

*Primary Examiner* — David P Porta
*Assistant Examiner* — Benjamin Schmitt
(74) *Attorney, Agent, or Firm* — Fitzpatrick, Cella, Harper & Scinto

(57) ABSTRACT

An image forming apparatus includes an image bearing member for carrying a toner image; a transfer member for cooperating with the image bearing member to form a nip to transfer a toner image onto a transfer medium; transfer voltage applying means for applying a transfer voltage to the transfer member to transfer the toner image; detecting means for detecting a current when a monitor voltage is applied to the transfer member; transfer voltage determining means for determining the transfer voltage on the basis of a detection result of the detecting means so that current through the transfer member in a transfer operation is the target current; and target current adjusting means for adjusting the target current so that target current when a resistance of the transfer member is relatively small is larger than the target current when the resistance value of the transfer member is relatively large.

9 Claims, 6 Drawing Sheets

IMAGE FORMING APPARATUS

FIELD OF THE INVENTION AND RELATED ART

The present invention relates to a transferring apparatus, the transfer voltage of which is optimized based on the results of the measurement of the electric current flowed through the transferring member by applying preset voltages to the transferring member to monitor the performance of the transferring apparatus. More specifically, it relates to an active transfer voltage (ATVC) control for an image forming apparatus.

There has been put to practical use a full-color image forming apparatus characterized in that it uses an intermediary transfer belt or a recording medium conveying belt to sequentially place in layers multiple monochromatic images, which correspond in color to the primary colors into which the optical image of an intended color image has been separated. There have also been put to practical use an electrophotographic monochromatic image forming apparatus, and an electrophotographic full-color image forming apparatus, which are controlled to be stable in transfer voltage.

In the case of an image forming apparatus designed so that voltage (primary transfer voltage) is applied to the transferring member to transfer (primary transfer) a toner image from the photosensitive drum onto the intermediary transfer belt, the primary transfer voltage must be very precisely controlled. In the case of a transferring apparatus controlled so that its transfer current remains constant, it is adjusted in the amount of transfer current by feedback. However, in the case of a transferring apparatus which is controlled so that its transfer voltage remains stable, the transfer voltage is not adjusted every moment. Therefore, its transfer current is affected by various factors, for example, nonuniformity among the components for the apparatus, nonuniformity among the materials for the components, changes in ambience, changes in the setting of an image forming apparatus, etc. Thus, in the case of a transferring apparatus, in accordance with the prior art, controlled so that its transfer voltage remains stable, it is possible that an image is unsatisfactorily transferred due to the improper amount by which transfer current flows.

Japanese Laid-open Patent Application H02-123385 discloses a monochromatic image forming apparatus equipped with an active transfer voltage control system (ATVC system). In the case of this image forming apparatus, before a toner image is transferred, its transferring apparatus is controlled so that the amount by which transfer current flows through the transferring member while the transferring member is in contact with the solid white portion of an image on the photosensitive drum (image bearing member) matches a preset target value. Then, in the following step, that is, the step in which the toner image is actually transferred, the transferring apparatus is controlled so that the transfer voltage remains stable at the level corresponding to the abovementioned target value used in the preceding step. In other words, the voltage (transfer voltage) applied to the transferring member is compensated for the change in the electrical resistance of the transferring member, which is attributable to the nonuniformity among the transferring members, the changes in the properties of the transferring member attributable to the lapse of time. That is, the voltage (transfer voltage) applied to the transferring member is adjusted roughly in proportion to the amount of electrical resistance of the transferring member. Therefore, with the use of this control sequence (ATVC), the amount by which electrical current flows through the transferring member is not affected by the nonuniformity among the transferring members, the changes in the properties of the transferring member attributable to the lapse of time. Therefore, it is ensured that the amount by which current (transfer current) flows through the transferring member matches the preset target value.

Japanese Laid-open Patent Application 2004-117920 discloses an ATVC for a full-color image forming apparatus in which multiple photosensitive drums are arranged in tandem along the intermediary transferring member. In the case of this ATVC, the amount by which current flows through the transferring member is measured while varying in steps the voltage (for monitoring transferring apparatus performance) outputted from a transfer voltage power source, while a toner image is not transferred. Then, the amount of the resistance of the transferring member is estimated based on the results of the measurement. Then, the value obtained by multiplying the estimated value of the transfer member resistance with a target transfer current value is used as a target value for the actual transfer voltage. The target amount for the transfer current is adjusted in detail according to the type of recording medium, the recording medium sheet size, the amount of toner per unit area of the recording medium (ratio of recording medium portion covered with toner). The thus obtained target values are organized in the form of a table, and are stored in a memory.

The ATVC disclosed in Japanese Laid-open Patent Applications H02-123385 and 2004-117920 can make an adjustment so that the amount by which electric current flows through the transferring member during the image transfer matches the target value. However, it was experimentally confirmed that if the electrical resistance of the transferring member substantially changes due to the lapse of time, changes in temperature, etc., an image was likely to be unsatisfactorily transferred. That is, it was confirmed that in the case of a transferring apparatus which is controlled so that transfer voltage remains stable (constant), if its transferring member increases in resistance while the transfer voltage, the magnitude of which is roughly proportional to the resistance of the transferring member, is applied to the transferring member, the transfer voltage is likely to become excessive, whereas as the transferring member reduces in resistance, the transfer voltage is likely to become insufficient.

That is, when a toner image is transferred from an image bearing member onto transfer medium (intermediary transferring member, recording medium, etc.), the transfer current supplied from a transfer voltage power source separates into the effective transfer current, that is, the current which flows through the areas of transfer medium (which hereafter will be referred to as transfer areas), onto which toner (developer) is transferred, and the bypass current, that is, the current which flows through the areas of transfer medium, which are outside the transfer areas. As the transferring member reduces in electrical resistance, the areas through which the bypass current flows increase in size. In other words, the bypass current increases in its ratio in the overall transfer current. Thus, even if the overall amount by which current flows through the transfer area matches a target value, the effective transfer current, that is, the current which actually counts, is insufficient.

On the other hand, if the transferring member happens to increase in electrical resistance, the consequence is opposite to that described above. That is, the effective transfer current increases in terms of its ratio relative to the overall transfer current. Thus, even if the overall amount by which current flows through the transfer area matches a target value, the effective transfer current, that is, the portion of the overall transfer current, which flows through the transfer area, becomes excessive.

SUMMARY OF THE INVENTION

The primary object of the present invention is to provide an image forming apparatus capable of optimizing transfer voltage to satisfactorily transfer an image even if its transferring member substantially changes in electrical resistance because of the lapse of time, temperature change, etc.

According to an aspect of the present invention there is provided an image forming apparatus comprising an image bearing member for carrying a toner image; a transfer member for cooperating with said image bearing member to form a nip to transfer a toner image from said image bearing member onto a transfer medium nipped by said nip; transfer voltage applying means for applying a transfer voltage to said transfer member to transfer the toner image; detecting means for detecting a current when a monitor voltage is applied to said transfer member or a voltage when a monitor current is applied; transfer voltage determining means for determining the transfer voltage on the basis of a detection result of said detecting means so that current through the transfer member in a transfer operation is the target current; and target current adjusting means for adjusting the target current so that target current when a resistance of said transfer member is relatively small is larger than the target current when the resistance value of said transfer member is relatively large.

According to another aspect of the present invention, there is provided an image forming apparatus comprising a belt member for carrying a toner image; a supporting member for supporting said belt member at a back side thereof; a transfer member, opposed to said supporting member with said belt member therebetween, for cooperating with said belt member to form a nip to transfer a toner image from said belt member onto a transfer medium nipped by said nip; potential difference forming means for providing a potential difference between said supporting member and said transfer member to transfer the toner image; detecting means for detecting a current when the potential difference is provided between said supporting roller and said transfer member or a voltage when a current is applied between said supporting roller and said transfer member; potential difference determining means for determining the potential difference on the basis of a detection result of said detecting means; so that current through said transfer member in a transfer operation is the target current; target current adjusting means for adjusting the target current so that target current when a resistance of said transfer member is relatively small is larger than the target current when the resistance value of said transfer member is relatively large.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatuses in the preferred embodiments of the present invention will be described in detail with reference to the appended drawings. The structure of the image forming apparatus in accordance with the present invention, which will be described next, is not intended to limit the present invention in terms of the structure of an image forming apparatus. That is, the present invention is also applicable to such an image forming apparatus which is partially or entirely different in structure from the image forming apparatus which will be described next, as long as the image forming apparatus is structured so that the transfer voltage applied to the transfer areas and the area outside the transfer areas is kept stable.

Further, not only is the present invention applicable to an image forming apparatus employing an intermediary transferring member, but also, an image forming apparatus employing a recording medium conveying belt or the like, and an image forming apparatus structured so that a toner image is directly transferred from its photosensitive drum onto recording medium. The image forming apparatuses in the following embodiments of the present invention will be described regarding only the portions related essentially to image transfer. However, the present invention is also compatible with a printer, a copying machine, facsimile machine, a multifunction image forming apparatus, and the like, which are different in external appearance and internal component ware from the image forming apparatuses in the following embodiments, because of their usage.

Incidentally, the image forming apparatus disclosed in Japanese Laid-open Patent Application 2004-117920 will not be illustrated, and also, will not be described in detail regarding the various power sources, the structure and control sequence of the transfer voltage (bias) control circuit.

<Image Forming Apparatus>

Figure 1:
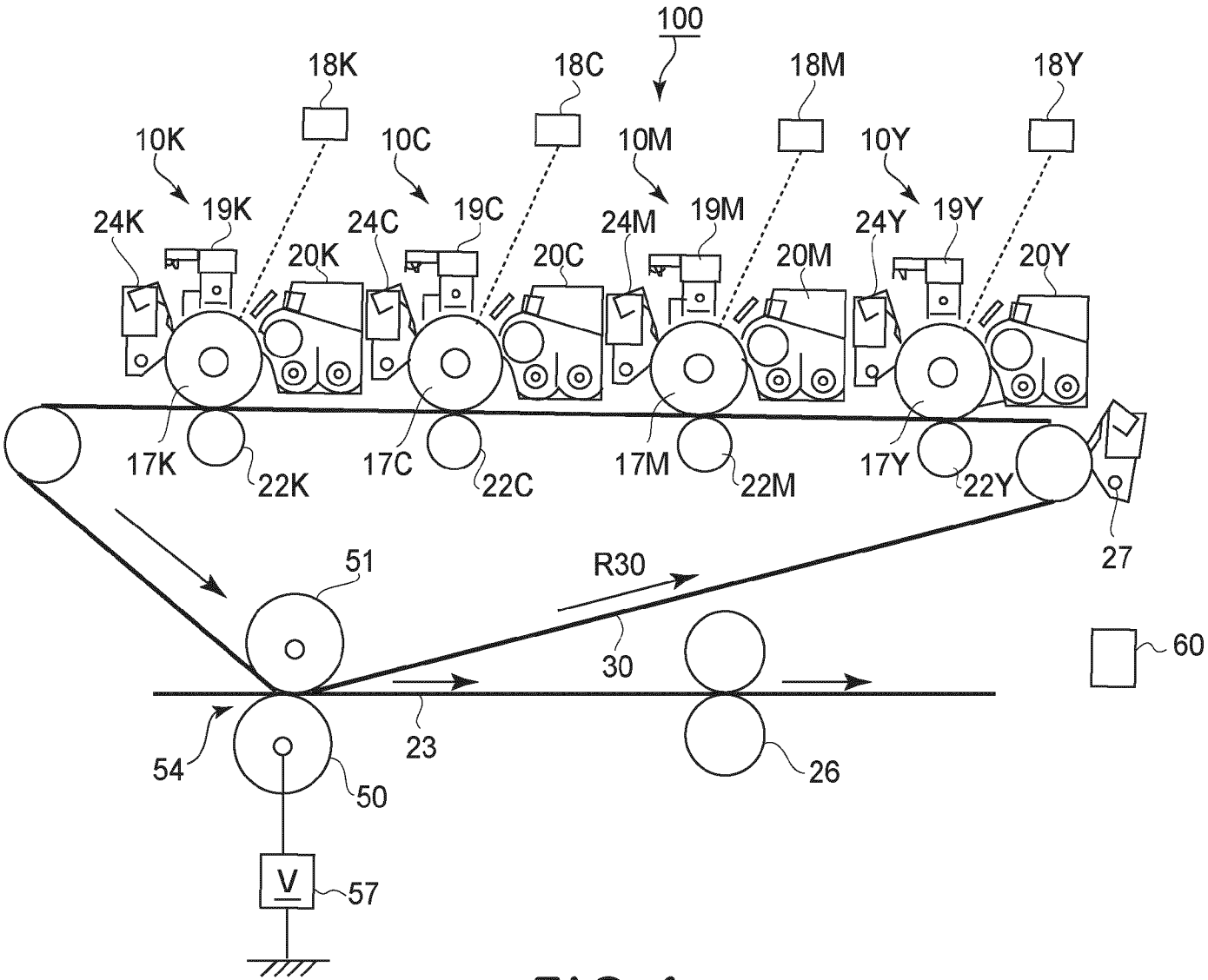
FIG. 1 is a sectional view of the image forming apparatus in the first embodiment of the present invention, showing the structures of the essential portions of the apparatus.
Figure 3:
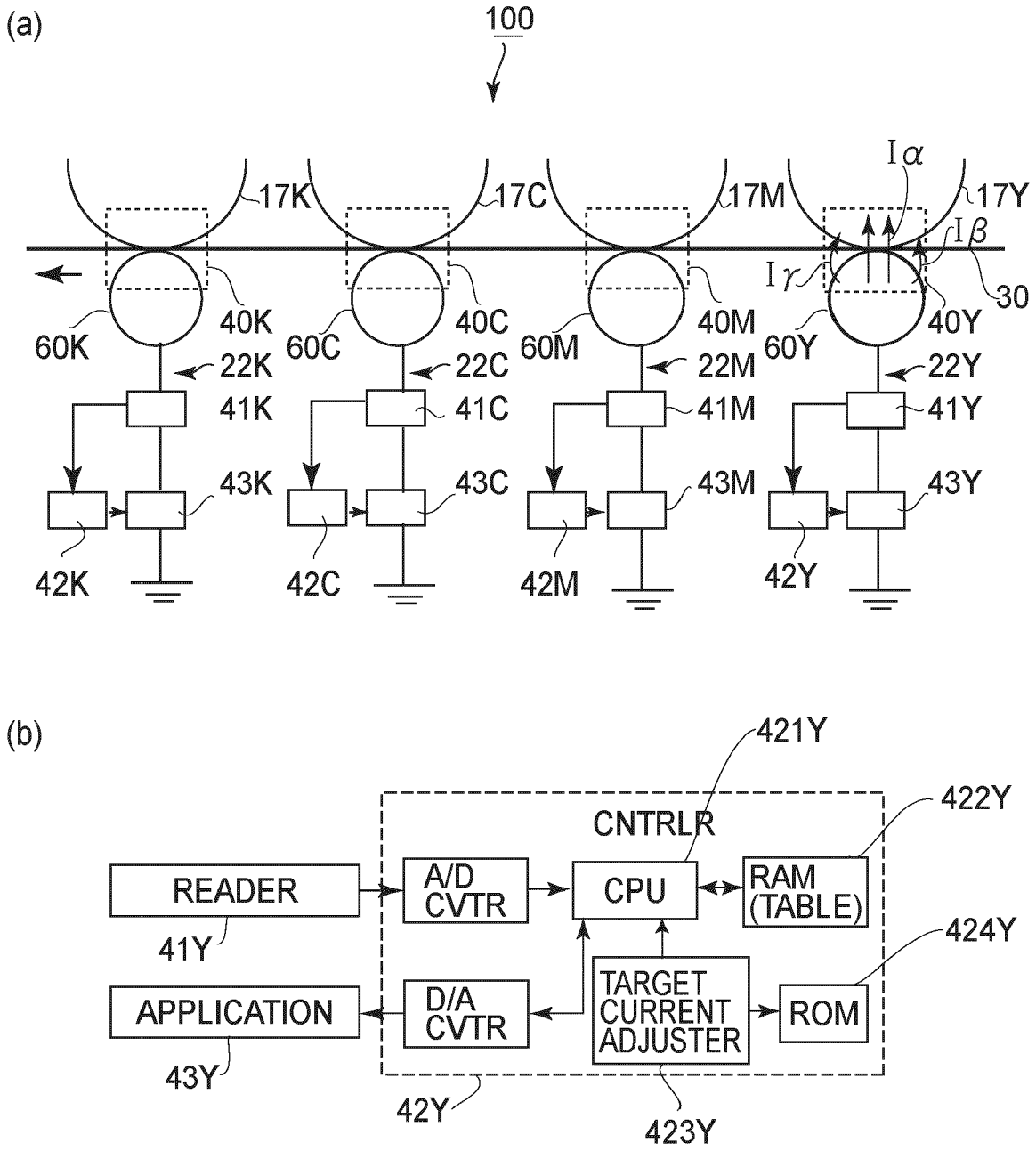
FIG. 3 is a combination of a schematic diagram of the transfer voltage control circuit, and a block diagram of the transfer voltage controlling portion, of the primary transferring apparatus.
Figure 4:
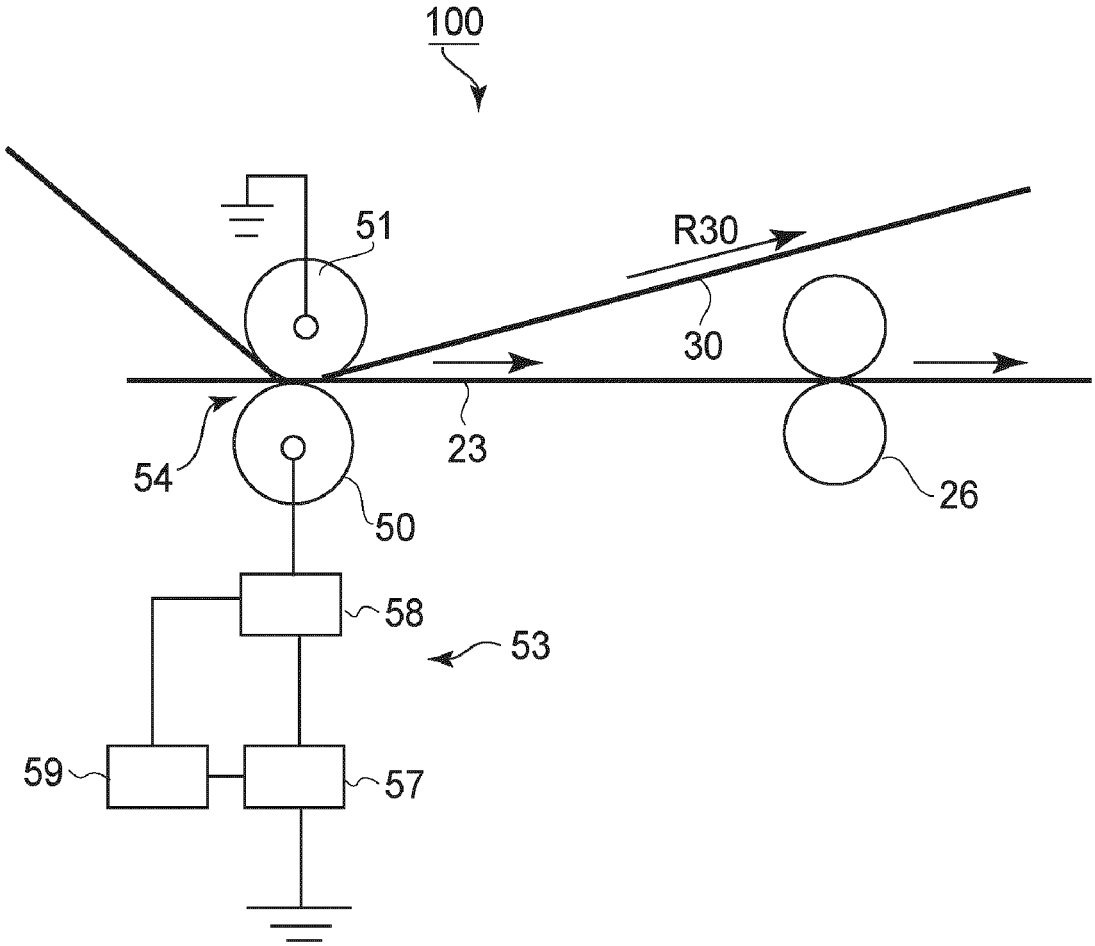
FIG. 4 is a schematic drawing for describing the means for controlling the transfer voltage of the secondary transferring apparatus.

FIG. 1 is a sectional view of the image forming apparatus in the first embodiment of the present invention, and shows the structures of the essential portions of the apparatus. FIG. 3 is a combination of a schematic diagram of the transfer voltage control circuit, and a block diagram of the transfer voltage controlling portion, of the primary transferring apparatus. FIG. 4 is a schematic drawing of the means for controlling the transfer voltage of the secondary transferring apparatus.

Referring to FIG. 1, the image forming apparatus 100 is a full-color image forming apparatus having image forming portions 10Y, 10M, 10C, and 10K, which form yellow, magenta, cyan, and black toner images, respectively, and an intermediary transferring member 30. The image forming portions 10Y, 10M, 10C, and 10K are arranged in tandem along the intermediary transfer belt 30.

The developing apparatus 20Y of the image forming portion 10Y is filled with yellow toner (yellow developer). On the photosensitive drum 17Y (image bearing member), an electrostatic latent image, which corresponds to a yellow monochromatic image, is formed. The developing apparatus 20M of the image forming portion 10M is filled with magenta toner (magenta developer). On the photosensitive drum 17M (image bearing member), an electrostatic latent image, which corresponds to a monochromatic magenta image, is formed. The developing apparatus 20C of the image forming portion 10C is filled with cyan toner (cyan developer). On the photosensitive drum 17C (image bearing member), an electrostatic latent image, which corresponds to a magenta monochromatic image, is formed. The developing apparatus 20K of the image forming portion 10K is filled with black toner (black developer). On the photosensitive drum 17K (image bearing member), an electrostatic latent image, which corresponds to a black monochromatic image, is formed.

The image forming portions 10Y, 10M, 10C, and 10K are the same in structure, although they are different in the color of the developer which the developing apparatuses 20Y, 20M, 20C, and 20K store. Thus, the structure of the image forming portion will be described with reference to the image forming portion 10Y; the description of the image forming portions 10M, 10C, and 10K is the same as that of the image forming portion 10Y, except for the referential suffixes M, C, and K, which pertain to the color of the toner with which they are filled.

The image forming portion 10Y has a photosensitive drum 17Y (drum-shaped electrophotographic photosensitive member), and multiple processing means, more specifically, a primary charging apparatus 19Y, an exposing apparatus 18Y, a developing apparatus 20Y, a primary transferring apparatus 22Y, a cleaner 24Y, etc., which are arranged in the adjacencies of the peripheral surface of the photosensitive drum 17Y in a manner to surround the photosensitive drum 17Y. The photosensitive drum 17Y is rotationally driven by an unshown driving means in the rightward direction in the drawing. The primary charging apparatus 19Y uniformly charges the peripheral surface of the photosensitive drum 17Y to the negative polarity.

The exposing apparatus 18Y forms an electrostatic latent image on the uniformly charged peripheral surface of the photosensitive drum 17Y, by projecting a yellow optical image, that is, one of the monochromatic optical images obtainable by separating the optical image of an original, or an optical image equivalent to this yellow optical image. More specifically, the peripheral surface of the photosensitive drum 17Y is scanned with a beam of laser light which is emitted by the exposing apparatus 18Y while being modulated with pictorial signals, and which is deflected by a rotating mirror. As development voltage (negative voltage) is applied to the developing apparatus 20Y, the yellow toner, which has been negatively charged, is electrostatically adhered to the numerous exposed points of the electrostatic latent image to develop the electrostatic latent image. As a result, a visible image is formed on the peripheral surface of the photosensitive drum 17Y.

Referring to FIG. 3, the primary transferring apparatus 22Y is made up of the intermediary transfer belt 30 (intermediary transferring member, transfer medium), and a primary transfer roller 60Y (transferring member) which is kept pressed against the photosensitive drum 17Y with the presence of the intermediary transfer belt 30 between the photosensitive drum 17Y and primary transfer roller 60Y. To the primary transfer roller 60Y, primary transfer voltage (transfer bias), which is opposite (positive) in polarity to that of the toner, is applied from a primary transfer voltage applying portion 43Y (transfer voltage power source). As the primary transfer voltage is applied, the toner image on the photosensitive drum 17Y transfers (primary transfer) onto the intermediary transfer belt 30.

Referring to FIG. 1, the cleaner 24Y removes the toner remaining on the peripheral surface of the photosensitive drum 17Y after the primary transfer, to prepare for the formation of the next toner image. As for the photosensitive drums 17M, 17C, and 17K, magenta, cyan, and black toner images are formed thereon, respectively, as is the yellow toner image formed on the photosensitive drum 17Y. Then, the magenta, cyan, and black toner images are sequentially transferred (primary transfer) onto the intermediary transfer belt 30 by the primary transferring apparatuses 22M, 22C, and 22K, respectively, so that they are placed in layers on the yellow toner image on the intermediary transfer belt 30. The intermediary transfer belt 30 rotates in the direction indicated by an arrow mark R, conveying thereby the toner images on the intermediary transfer belt 30 to a secondary transferring portion 54.

Referring to FIG. 4, the secondary transferring apparatus 53 is made up of an outside secondary transfer roller 50 and an inside secondary transferring roller 51, which are kept pressed against each other, with the presence of the intermediary transfer belt 30 between the two rollers 50 and 51, forming thereby a nip between the intermediary transfer belt 30 and outside secondary transfer roller 50. The inside secondary transfer roller 51 is grounded. To the outside secondary transfer roller 50, secondary transfer voltage (bias), which is opposite (positive) in polarity to that of the toner charge, is applied from a secondary transfer voltage applying portion 57. The four toner images layered on the intermediary transfer belt 30 are transferred together (secondary transfer) onto the recording medium 23 by the electric field formed between the outside secondary transfer roller 50 and inside secondary transfer roller 51, while the recording medium 23 is conveyed through the secondary transfer nip.

Referring again to FIG. 1, to the secondary transferring portion 54, the recording medium 23 is conveyed from an unshown sheet feeding-and-conveying apparatus in synchronism with the arrival of the toner images on the intermediary transfer belt 30 at the secondary transferring portion 54. The intermediary transferring member cleaner 27 removes the toner remaining on the surface of the intermediary transfer belt 30 after the secondary transfer, to prepare the intermediary transfer belt 30 for the primary transfer of the next toner image.

After the layered toner images on the intermediary transfer belt 30 are transferred together (secondary transfer) onto the recording medium 23, the recording medium 23 is conveyed to a fixing apparatus 26. In the fixing apparatus 26, the recording medium 23, and the toner images thereon, are subjected to heat and pressure in the fixation nip of the fixing apparatus 26. As a result, the toner images become fixed to the recording medium 23. Thereafter, the recording medium 23, on which a full color toner image has just been formed through the steps described above, is discharged from the image forming apparatus 100.

A portion of the peripheral surface of the photosensitive drum 17Y of the image forming apparatus 100, across which toner is present, and a portion of the peripheral surface of the photosensitive drum 17Y of the image forming apparatus 100, across which no toner is present, are different in electrical resistance, by the amount of electrical resistance provided by the toner which is present across the former. Thus, the former is more difficult for electric current to flow through, than the latter. Therefore, if the primary transfer voltage is controlled so that the amount of transfer current remains stable, the amount by which current flows through the portion with toner is affected by the ratio between the portion with toner and the portion without toner (image ratio in transfer nip N). Therefore, it is unlikely for an image to be satisfactorily transferred.

In comparison, if the primary transfer voltage is controlled so that it remains constant, the amount by which electric current flows through the portion with toner remains constant regardless of the changes in image ratio. Therefore, an image is satisfactorily transferred even across every nook and cranny. Thus, in the field of a full-color image forming apparatus which is required to be highly precise in image transfer, it is mainstream to control the transfer voltage so that it remains stable at a level corresponding to the target value for the transfer current, because unsatisfactory image transfer is one of the essential causes of the formation of an image nonuniform in color.

However, the primary transfer roller 60Y, intermediary transfer belt 30, etc., change in the amount of electrical resistance with the lapse of time. For example, if the electrically conductive substance(s) in these components deteriorate with the lapse of time, they increase in electrical resistance. Further, if these components change in temperature due to the changes in the condition under which they are used, they increase (or decrease) in electrical resistance.

Therefore, if the transferring apparatus is controlled so that the primary transfer voltage, that is, the voltage applied to the primary transfer roller 60Y, remains stable at a preset level proportional to a preset target value for transfer current regardless of the changes in the abovementioned factors which affect the resistance of the primary transfer roller 60Y, the amount by which transfer current flows does not match the target value, and therefore, it is unlikely for a toner image to be satisfactorily transferred.

In the case of the image forming apparatus 100, therefore, the transferring apparatus is actively controlled (ATVC) to keep the transfer voltage stable at an optimal level. That is, if the primary transfer roller 60Y, intermediary transfer belt 30, etc., change in electrical resistance, the target value for transfer current is adjusted in response to the changes so that the amount by which effective transfer current flow through the transfer area, which includes the portion with toner and the portion with no toner, remains optimal regardless of the abovementioned changes.

The ATVC sequence is as follows: Referring to FIG. 3(*a*), the amount by which electric current flows through the primary transfer roller 60Y is measured while varying in several steps the voltage (transferring apparatus monitoring voltage) being applied to the primary transfer roller 60Y without forming an image on the photosensitive drum 17Y (while roller 60Y is in contact with area of photosensitive drum 17, which is free of a toner image). Then, the electrical resistance of the primary transferring portion 40Y is calculated based on the relationship between the transfer voltage levels and corresponding amounts by which electric current flowed through the primary transfer roller 60Y. Although the measured amount of the electrical resistance of the primary transferring portion 40Y includes the electrical resistances of the intermediary transfer belt 30, etc., as well as that of the primary transfer roller 60Y, it increases or decreases in response to the increase or decrease in the electrical resistance of the primary transfer roller 60Y. Then, a target value of transfer current is set based on the calculated electrical resistance of the primary transferring portion 40Y, and then, the target value for transfer voltage, that is, the voltage value necessary to flow electric current through the primary transferring portion 40Y by the amount matching the calculated target value, is calculated. Then, the transferring apparatus is controlled so that the voltage applied to the primary transfer roller 60Y remains stable at the calculated target level during an image forming operation.

Obviously, the portion of the peripheral surface of the photosensitive drum 17Y, across which an image is formed, is free of toner. Therefore, the preset target value for transfer current must be equal to the target value for the amount by which transfer current is flowed through the area having no toner. However, by measuring in advance the amount by which transfer current flows through the portion with no toner when transfer current is flowing by an optimal amount through the portion with toner, and using the measured amount by which transfer current flowed through the portion with no toner, as the target value for the transfer current, it is possible to obtain a proper level for the transfer voltage, at which the transfer voltage is to be kept stable.

Incidentally, the process speed of the image forming apparatus 100 is 200 mm/sec. Therefore, even when the image forming apparatus 100 is carrying out the ATVC sequence, the photosensitive drums 17Y, 17M, 17C, and 17K, and also, the intermediary transfer belt 30, are driven at a peripheral velocity of 200 mm/sec. In the first embodiment of the present invention, the operation of the primary transferring apparatuses 22Y, 22M, 22C, and 22K in the ATVC mode will be described, whereas in the second embodiment, the operation of the secondary transferring apparatus 53 in the ATVC mode will be described.

Incidentally, in the first and second embodiments of the present invention, the abovementioned ATVC sequence is executed right after the main assembly of the image forming apparatus 100 is turned on, and immediately before an image forming job is started.

Further, the target level (value) for the primary transfer voltage may be calculated by measuring the amount of voltage necessary to cause electric current (monitoring current) to flow through the primary transfer roller 60Y by a preset amount (monitoring amount), instead of measuring the amount of electric current while applying the monitor voltages.

Embodiment 1

Figure 5:
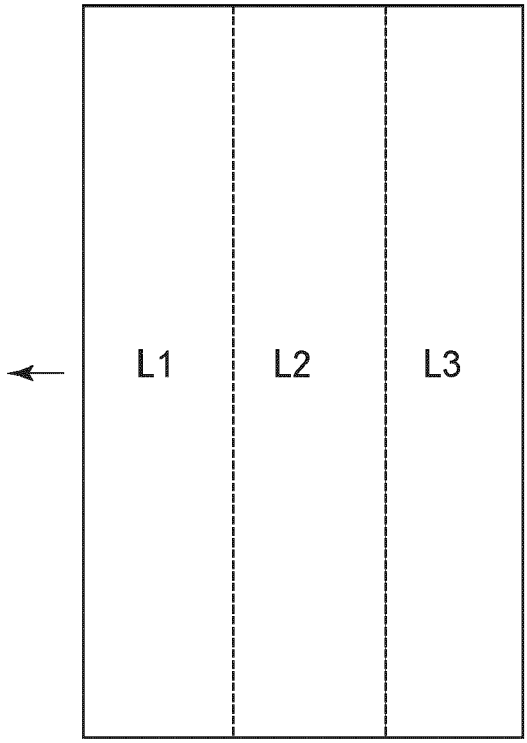
FIG. 5 is a rough drawing of an original of the solid white pattern used for ATVC (active transfer voltage control).
Figure 6:
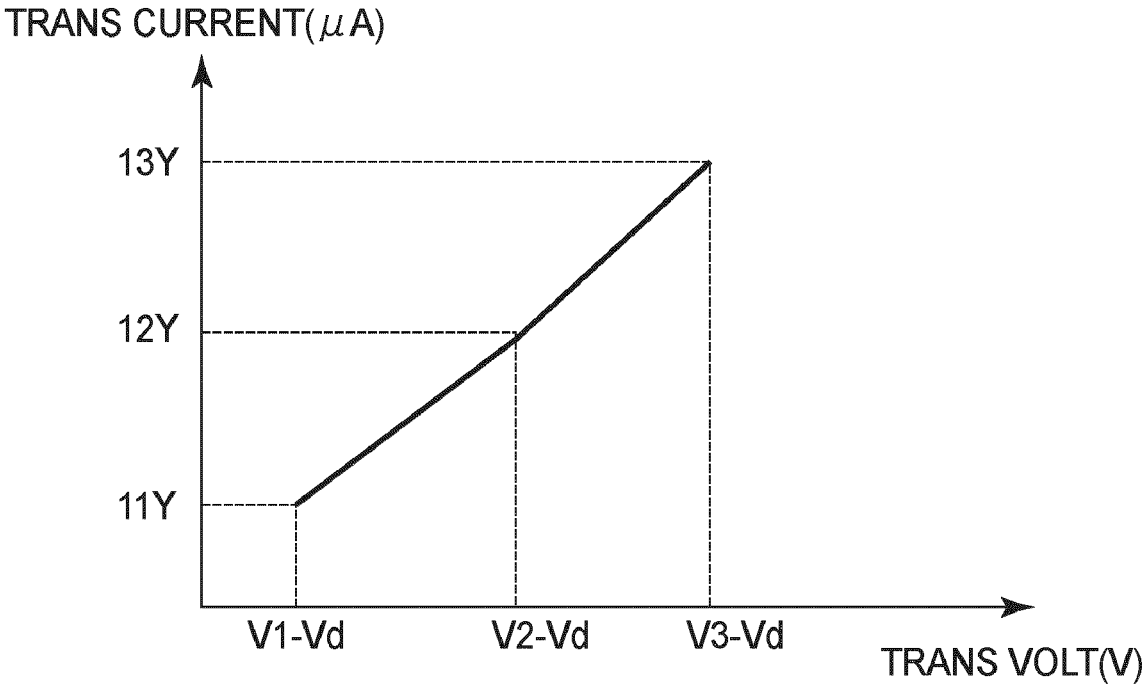
FIG. 6 is a graph showing the relationship between the amount of the voltage (for ATVC sequence) applied to the primary transfer portion, and the amount of current which flowed through the primary transfer portion.
Figure 7:
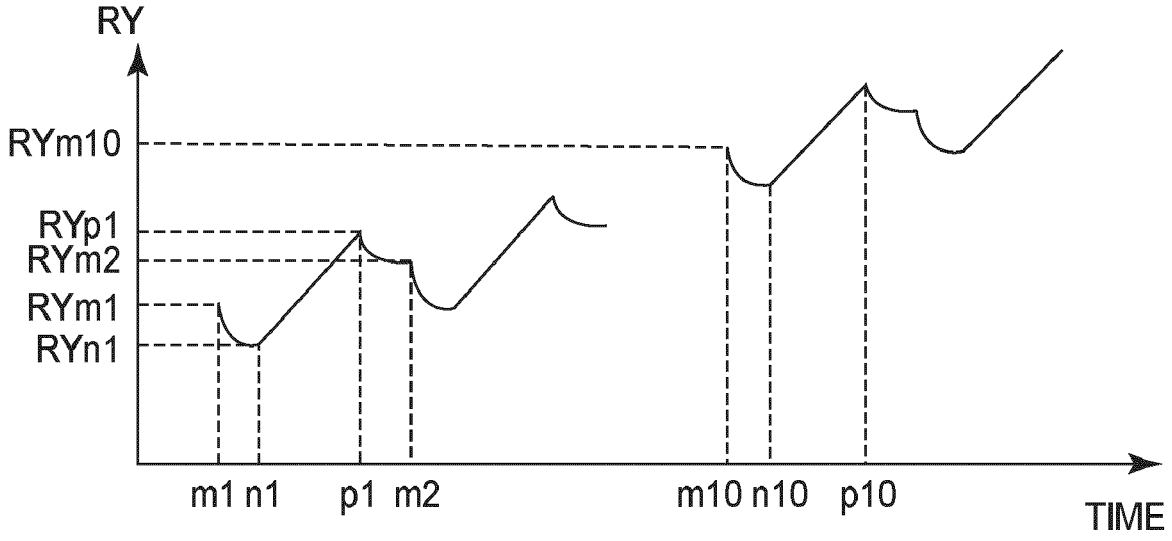
FIG. 7 is a graph showing the relationship between the electrical resistance of the primary transferring portion, and the lapse of time, showing the change in the resistance.
Figure 8:
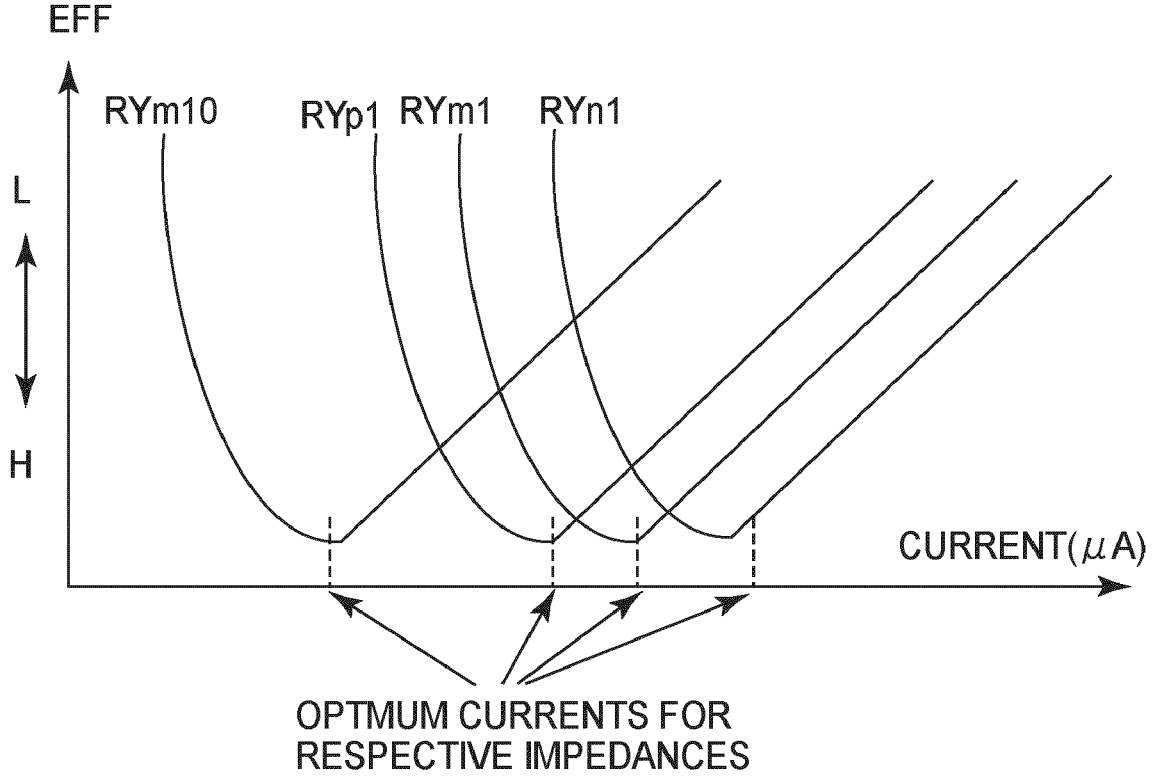
FIG. 8 is a graph showing the relationship among the electrical resistance of the primary transferring portion, measured amount of transfer current, and transfer efficiency, which is used for optimizing the amount by which the transfer current is to be flowed through the primary transferring portion.

FIG. 5 is a rough drawing of the original of the solid white pattern used for ATVC. FIG. 6 is a graph showing the relationship between the amount of the voltage (for ATVC sequence) applied to the primary transfer portion, and the amount of current which flowed through the primary transfer portion. FIG. 7 is a graph showing the relationship between the electrical resistance of the primary transferring portion, and the lapse of time. FIG. 8 is a graph showing the relationship between the measured amount of transfer current and the transfer efficiency, which is used for optimizing the amount by which the transfer current is to be flowed through the primary transfer portion.

Referring to FIG. 3(*a*), the primary transfer voltage controlling portion (controlling means) 42Y, 42M, 42C, and 42K control the primary transfer voltage applying portions (voltage applying means) 43Y, 43M, 43C, and 43K, respectively. The primary transfer voltage controlling portions 42Y, 42M, 42C, and 42K calculate proper values for the primary transfer voltages, one for one, based on the outputs from the primary transfer current reading portions 41Y, 41M, 41C, and 41K (detecting means), and control the primary transfer voltage applying portions 43Y, 43M, 43C, and 43K (voltage applying means), respectively. The primary transfer voltage controlling portion 42Y, 42M, 42C, and 42K are the same in structure. The primary transferring portions 40Y, 40M, 40C, and 40K are the same in the operation in the ATVC mode. Therefore, the ATVC sequence will be described with reference to the primary transferring apparatus 22Y; the description of the ATVC sequence carried out by the primary transfer voltage control portions 42M, 42C, and 42K is the same as that carried out by the primary transfer voltage controlling portion 42Y, except for the referential suffixes M, C, and K, which pertain to the color of the toner with which they are filled.

The primary transfer nip is formed between the intermediary transfer belt 30 and photosensitive drum 17Y by pressing the primary transfer roller 60Y against the photosensitive drum 17Y with the interposition of the intermediary transfer belt 30 between the primary transfer roller 60Y and photosensitive drum 17Y. The primary transferring portion 40Y is the primary transfer nip and its adjacencies. The normal polarity of the toner charge is negative. Right after the peripheral surface of the photosensitive drum 17Y is charged by the charging apparatus 19Y, the surface potential level of the photosensitive drum 17Y is −500 V. After the peripheral surface of the photosensitive drum 17Y is processed by the exposing apparatus 18Y, the electrical potential of the "exposed" points of the peripheral surface of the photosensitive drum 17Y is −200 V. Toner is adhered to the "exposed" points of the peripheral surface of the photosensitive drum 17Y, that is, the point having −200 V of electrical potential, with the use of −300 V of DC voltage (transfer bias).

The primary transfer roller 60Y is made up of an axle, and a single layer of sponge made up of urethane which contains ion-conductive substance(s). The sponge layer is 16 mm in diameter. The amount of the electrical resistance of the primary transfer roller 60Y is adjusted by controlling the amount by which ion-conductive substance(s) is added to the urethane as the material for the spongy layer of the primary transfer roller 60Y. The volumetric resistivity of the primary transfer roller 60Y is in a range of $1\times10^{6}$-$1\times10^{7}\Omega$. The intermediary transfer belt 30 is not laminar, and is formed of polyimide resin in which carbon particles have been dispersed Its electrical resistance is adjusted by adjusting the amount by which carbon particles are dispersed in the polyimide resin as the material for the intermediary transfer belt 30. The volumetric resistivity of the intermediary transfer belt 30 is in a range of $1\times10^{8}$-$1\times10^{9}\Omega$, and the surface resistivity of the intermediary transfer belt 30 is in a range of $1\times10^{11}$-$1\times10^{12}\Omega$.

The image forming apparatus 100 obtains the proper (optimal) value for the primary transfer voltage, by performing the ATVC sequence, which includes the measurement of the electrical resistance of the primary transferring portion 40Y. Then, it controls its primary transferring portion 40Y so that the transfer voltage applied to the primary transfer roller 60Y remains stable at the proper (optimal) level.

The reason for controlling the transferring apparatus so that the transfer voltage remains stable is to keep stable the current which flows through the portion of the image area, which has toner, in order to ensure that a toner image is satisfactorily transferred, regardless of the image ratio of the toner image to be transferred.

That is, the portion of the primary transfer nip, which corresponds to the portion of the peripheral surface of the photosensitive drum 17Y, which has toner, and the portion of the primary transfer nip, which corresponds to the portion of the peripheral surface of the photosensitive drum 17Y, which has no toner, are different in the amount of electrical resistance, which is roughly proportional to the amount of toner thereon. Therefore, the former is more difficult for electric current to flow through than the latter. Thus, if the primary transfer voltage is controlled so that the amount by which electric current flows through the primary transfer nip remains stable, the amount by which electrical current flows through the portion of the primary transfer nip, which corresponds to the portion of the peripheral surface of the photosensitive drum 17Y, which has toner is affected by the change in the ratio between the portion of the primary transfer nip, which corresponds to the portion of the peripheral surface of the photosensitive drum 17Y, which has toner, and the portion of the primary transfer nip, which corresponds to the portion of the peripheral surface of the photosensitive drum 17Y, which has no toner, making it difficult to satisfactorily transfer a toner image from the photosensitive drum 17Y onto the intermediary transfer belt 30. In comparison, if the transfer voltage is controlled so that it remains stable, the amount by which electric current flows through the portion of the primary transfer nip, which corresponds to the portion of the peripheral surface of the photosensitive drum 17Y, which has toner, remains stable, regardless of the change in the ratio between the portion of the primary transfer nip, which corresponds to the portion of the peripheral surface of the photosensitive drum 17Y, which has toner, and the portion of the primary transfer nip, which corresponds to the portion of the peripheral surface of the photosensitive drum 17Y, which has no toner.

Another reason for actually measuring the electrical resistance of the primary transferring portion 40Y to determine a level at which the primary transfer voltage is to be kept stable is that the primary transfer roller 60Y and intermediary transfer belt 30 of the primary transferring portion 40Y change in the amount of electric resistance with the lapse of time. For example, as ion-conductive substance(s) in the material for the abovementioned components deteriorates with usage or lapse of time, the components increase in electrical resistance. Also, the components of the primary transferring portion 40Y are likely to change in temperature due to the change in the ambience in which the image forming apparatus is operated, and the change in the temperature of the components affects (increases or decreases) the electrical resistance of the components.

Thus, unless the change in the electrical resistance of the components of the primary transferring portion 40Y, and/or the like is taken into consideration, even if the primary transfer voltage is controlled so that it remains stable at a level which corresponds to the optimal amount of primary transfer current, it is not ensured that the primary transfer current remains stable at the optimal level, and therefore, it is not ensured that a toner image is always satisfactorily transferred.

In this embodiment, therefore, in order to ensure that the amount by which the primary transfer current flows through the portion of the primary transfer nip, which corresponds to the portion of the peripheral surface of the photosensitive drum 17Y, which has toner, always remains at the optimal level, the electrical resistance of the primary transferring portion 40Y (electrical resistance of primary transfer roller 60Y and intermediary transfer belt 30) is actually measured, and the primary transfer voltage is controlled in consideration of the measured (actual) electrical resistance of the primary transferring portion 40.

Figure 2:
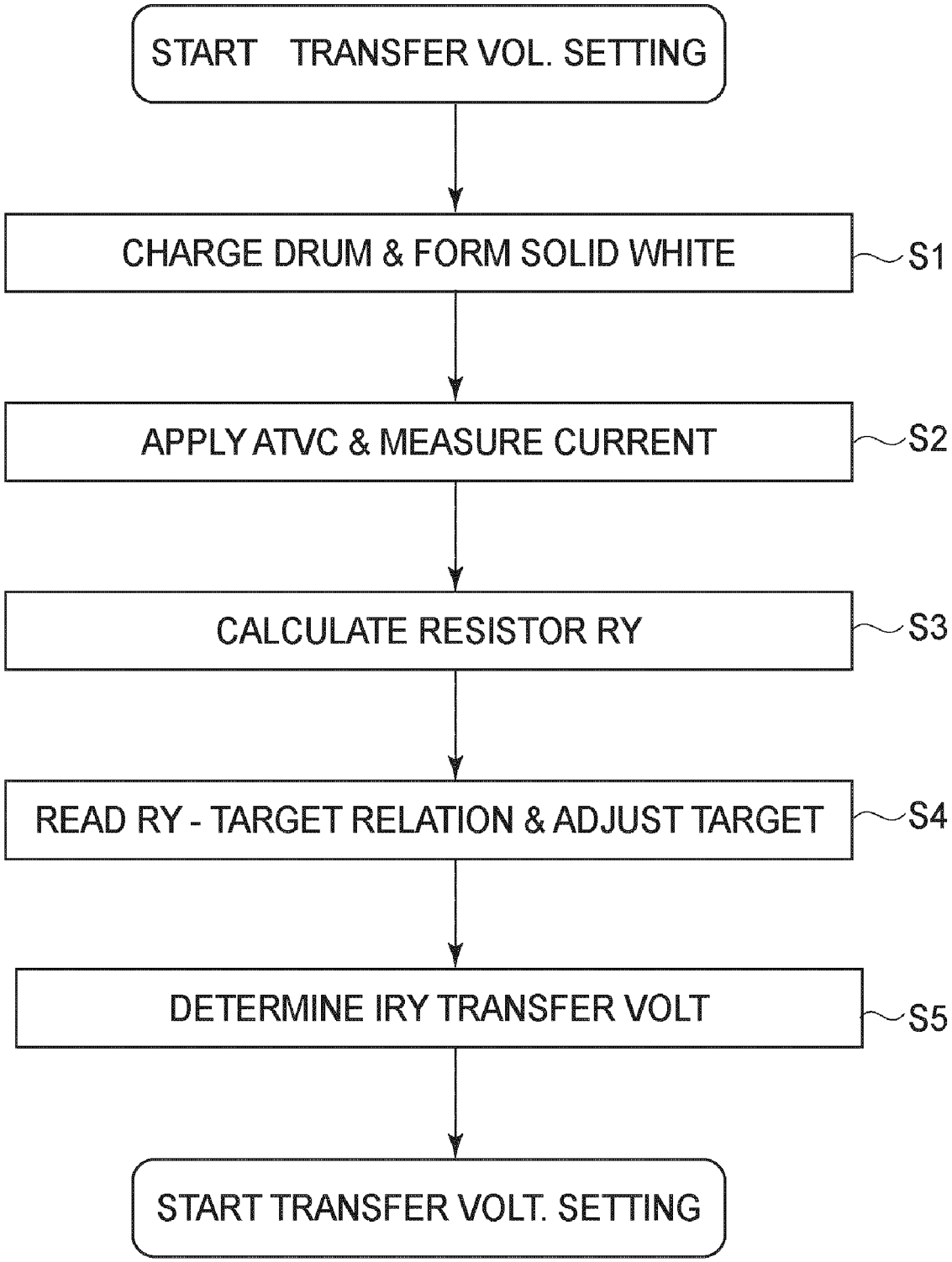
FIG. 2 is a flowchart for setting transfer voltage.

Next, referring to in FIG. 2 (flowchart), the active transfer voltage control sequence, which is the gist of the present invention, will be described.

The ATVC sequence is performed to optimize the amount by which electric current (primary transfer current) flows through the primary transferring portion 40Y (FIG. 3(*a*)) during an image forming operation. It is performed while an image is not formed, that is, it is performed using the portion of the peripheral surface of the photosensitive drum 17Y, which is not being used for image formation. First, an image of the solid white pattern for ATVC is formed on the peripheral surface of the photosensitive drum 17Y with the use of the primary charging apparatus 19Y, laser beam exposing apparatus 18Y, and developing apparatus 20Y, prior to the starting of an actual image forming operation (S1 in FIG. 2). The size of the solid white image formed on the photosensitive drum 17Y is as follows. In terms of the direction parallel to the axial line of the photosensitive drum 17Y, the solid white image is as wide as the widest image formable by the image forming apparatus, and in terms of the direction parallel to the rotational direction of the photosensitive drum 17Y, the solid white image is roughly 150 mm, which is three times as long as the circumference of the primary transfer roller 60Y. The condition under which the copy of the solid white image is formed on the photosensitive drum 17Y is the same as the condition under which the solid white portion, that is, the portion of an image, which is free of toner, is formed in an actual image forming operation. In the case of the image forming apparatus 100 in this embodiment, the potential level Vd of the portion of the peripheral surface of the photosensitive drum 17Y, which corresponds to the solid white image, is the same as the potential level of the peripheral surface of the photosensitive drum 17Y immediately after the photosensitive drum 17Y is charged by the primary charging apparatus, that is, Vd=−500 V; in other words, it has not been affected by the exposing process.

Referring to FIG. 3(*a*), the primary transfer voltage controlling portion 42Y causes the primary transfer voltage applying portion 43Y to output a preset voltage V1 (monitoring voltage for ATVC), in synchronism with the arrival of the solid white image for ATVC on the photosensitive drum 17Y at the primary transfer portion 40Y. Thereafter, the primary transfer voltage controlling portion 42Y sequentially causes the primary transfer voltage applying portion 43Y to output preset voltages V2 and V3 (monitoring voltage for ATVC) with preset intervals. As a result, the voltages V1, V2, and V3 (monitoring voltages for ATVC) are sequentially applied to the primary transfer roller 60Y. The values of the voltages V1, V2, and V3 for ATVC in this embodiment are 500 V, 1,500 V, and 3,000 V, respectively (S2 in FIG. 2).

Referring to FIG. 5, while the primary transfer roller 60Y is in contact with the first ⅓ (area L1) of the solid white image for ATVC, in terms of the rotational direction of the photosensitive drum 17Y, the voltage V1 is applied to the primary transfer roller 60Y, and while the primary transfer roller 60Y is in contact with the second ⅓ (area L2) of the solid white image for ATVC, the voltage V2 is applied to the primary transfer roller 60Y. Further, while the primary transfer roller 60Y is in contact with the third ⅓ (area L3) of the solid white image for ATVC, the voltage V3 is applied to the primary transfer roller 60Y. That is, each of the voltages V1, V2, and V3 (monitoring voltages for ATVC) is applied to the primary transfer roller 60Y for a length of time corresponding to the external circumference of the primary transfer roller 60Y.

Then, the CPU 421Y (transfer voltage determining means) of the primary transfer voltage controlling portion 42Y, which is shown in FIG. 3(*b*), sets an optimal value for the primary voltage by accessing the RAM into which the programs and table stored in the ROM have been transferred. The digital signals which represent the voltages V1, V2, and V2 for ATVC are converted into analog voltages, and transmitted to the primary transfer voltage applying portion 43Y. As the thus obtained voltages are transmitted to the primary transfer voltage applying portion 43Y, primary transfer voltages are applied to the primary transfer roller 60Y so that they remain stable consecutively at the voltages V1, V2, and V3 for ATVC. The amounts of the primary transfer currents 11Y, 12Y, and 13Y which flow through the primary transfer roller 60Y while the transfer voltages are kept stable at levels V1, V2, and V3, respectively, are measured by the primary transfer current reading portions 41Y, and the value of the electrical resistance RY of the primary transfer roller 60 Y is calculated by the CPU 421Y of the primary transfer voltage controlling portion 42Y (S3 in FIG. 2).

Referring to FIG. 6, while the voltage V1 for ATVC is applied to the primary transfer roller 60Y, the transfer current 11Y is flowed by the difference in potential between the voltage V1 for ATVC and the potential level Vd of the photosensitive drum 17Y. While the voltages V2 and V3 for ATVC are applied to the primary transfer roller 60Y, the transfer current 12Y and 13Y are flowed by the difference in potential between the voltage V2 for ATVC and the potential level Vd of the photosensitive drum 17Y, and the difference between in potential between the voltage V3 for ATVC and the potential level Vd of the photosensitive drum 17Y, respectively. The CPU 421Y of the primary transfer voltage controlling portion 42Y calculates the amount of the electrical resistance RY of the primary transfer portion 40Y, based on the value of the potential level Vd of the photosensitive drum 17Y, values of the voltages V1, V2, and V3 for ATVC, and values of the transfer currents 11Y, 12Y, and 13Y for ATVC, respectively.

Then, the optimal value (target value) for the transfer current is selected according to the calculated value of the electrical resistance RY of the primary transfer portion 40Y. The following table shows the target values for the transfer currents ItY, ItM, ItC, and ItK, which correspond to the amounts of the electrical resistance of the primary transfer portions 40Y, 40M, 40C, and 40K, which correspond to the primary colors, one for one. It is in the RAMs 422Y, 422M, 422C, and 422K of the primary transfer voltage controlling portion 42Y, 42M, 42C, and 42K, respectively, that tables similar to Table 1 are stored, one for one. The current value setting device 423Y (current amount adjusting means) of the primary transfer voltage controlling portion 42Y sets the amount by which transfer current is to be flowed to the selected target (optimal) value which is in accordance with the value of the electrical resistance RY of the primary transfer roller 60Y, based on the Table 1 stored in ROM 424Y (S4 in FIG. 2). The target values for the amounts of the transfer currents for the colors other than yellow are set in the same manner as that for yellow color.

Incidentally, the measured electrical resistance of the primary transferring portion 40 includes the electrical resistance of the intermediary transfer belt 30, etc. However, the change in the electrical resistance of the primary transferring portion 40 is primarily attributable to that of the primary transfer roller 60Y. Thus, the target values for the amount of the transfer current ItY, ItM, ItC, and ItK are set so that the smaller in electrical resistance the primary transfer rollers 60Y, 60M, 60C, and 60K, the greater the target values for the amounts by which transfer current is flowed through the primary transfer rollers 60Y, 60M, 60C, and 60K.

TABLE 1

| | RY, RM, RC, RK ($\times 10^7\ \Omega$) | | | | | | | |
|---|---|---|---|---|---|---|---|---|
| | −1.0 | −1.5 | −2.0 | −2.5 | ... | −4.0 | −4.5 | −5.0 |
| ItY | 115 | 107 | 100 | 95 | ... | 80 | 76 | 72 (μA) |
| ItM | 106 | 100 | 95 | 90 | ... | 75 | 70 | 65 (μA) |
| ItC | 110 | 104 | 97 | 92 | ... | 77 | 72 | 68 (μA) |
| ItK | 85 | 80 | 75 | 70 | ... | 55 | 50 | 46 (μA) |

Lastly, the amount of primary transfer voltage which has to be applied to the primary transferring portion 40Y to cause the target amount of electric current (transfer current) to flow through the primary transferring portion 40Y is calculated based on the relationship between the values of the applied voltages V1, V2, and V3 for ATVC, and the amounts of the currents flowed through the primary transferring portion 40Y by the voltages V1, V2, and V3 for ATVC, respectively. Then, the thus obtained value is used as the target value for the primary transfer voltage. The target value for the amount by which primary transfer current is to be flowed through the primary transferring portion 40Y is the same as the value set by the current value setting device 423Y based on the value of the electrical resistance of the primary transferring portion 40Y.

The CPU 421Y obtains the value of the resistance RY of the primary transfer portion 40Y using the following equation:

$$R(Y)=((V1-Vd)/11Y+(V2-Vd)/12Y+(V3-Vd)/13Y)/3 \quad (1).$$

The values of the resistance RM, RC, and RK of the primary transferring portions 40M, 40C, and 40K are obtained using the same equation as Equation (1), except for referential suffixes.

Regarding the resistance RY, 30 minutes after the image forming apparatus 100 was turned on and a printing operation was started and continued, the amount of the current flowed by the transfer voltage for ATVC was as follows: 11Y=40 μA, 12Y=80 μA, and 13Y=140 μA. Thus, the value of the resistance of the primary transfer roller 60Y obtainable by Formula (1) is:

$$\begin{aligned} R(Y) &= ((500V - -500\text{ V})/40\,\mu A + \\ &\quad (1500V - -500\text{ V})/80\,\mu A + \\ &\quad (3000 - -500\text{ V})/140\,\mu A))/3 \\ &= 2.5\times 10^7\,\Omega. \end{aligned}$$

Next, the reason for adjusting the target values for the amounts of transfer current ItY, ItM, ItC, and ItK in response to the change in the value of the resistances RY, RM, RC, and RK will be described with reference to the case of the primary transferring portion 40Y.

Referring to FIG. 3, when the image forming apparatus 100 was subjected to a durability test in an ambience which was 23° C. in temperature and 50% in relative humidity, the resistance RY of the primary transfer portion 40Y significantly fluctuated as shown in FIG. 7, and so did the resistances RM, RC, and RK of the primary transferring portion 40M, 40C, and 40K, respectively. However, the reason for the adjustment of the target values for the amount of transfer currents ItM, ItC, and ItK will not be described.

In FIG. 7, a referential symbol m1 stands for the point in time immediately after the image forming apparatus 100 was turned on the first day, and a referential symbol n1 stands for the point in time one hour thereafter on the first day. A referential symbol p1 stands for the point in time eight hours (immediately before apparatus was turned off) after the apparatus 100 was turned on the first day. The image forming apparatus 100 was also subjected on the second (m2), third (m3), and fourth (m4) days, and so on, to the same endurance test as the one it was test in the first day. In other words, a referential symbol m10 stands for the point in time immediately after the image forming apparatus 100 was turned on; n10 stands for the point in time one hour after the apparatus 100 was turned on the tenth day; and p10 stands for the point in time eight hours (immediately before apparatus 100 was turned off) after the apparatus 100 was turned on the tenth day. As will be evident from FIG. 7, the resistance RY of the primary transfer portion 40Y significantly fluctuated in a single day, even when the ambience in which the image forming apparatus 100 was operated remained stable.

The resistance RY of the primary transfer portion 40Y at m1, that is, immediately after the image forming apparatus 100 was turned on the first day was $2\times 10^7\Omega$. However, the resistance RYn1, that is, the resistance RY of the primary transfer portion 40Y at n1, that is, one hour after the apparatus 100 was turned on the first day, was $1.5\times 10^7\Omega$, because the primary transfer roller 60Y, intermediary transfer belt 30, etc. were warmed by the image forming operation. Thereafter, the primary transfer roller 60Y, intermediary transfer belt 30, etc., continuously increased in electrical resistance while the operation of the image forming apparatus 100 was continued. By the end of the printing operation the first day, the resistance of the primary transfer portion 40Y had increased to $3\times 10^7\Omega$; resistance RYp1, that is, the resistance RY at p1 (eight hours after apparatus 100 was turned on first day), was $3\times 10^7\Omega$. The reason for the occurrence of this phenomenon was thought to be that the repetitive voltage application in the same direction caused the conductive substance(s) in the primary transfer roller 60Y and intermediary transfer belt 30 to progressively deviate.

The resistance RYm2, that is, the resistance RY of the primary transfer portion 40Y immediately after the apparatus 100 was turned on, was $2.1\times 10^7\Omega$, being therefore lower than the resistance RY of the primary transfer portion 40Y at the point p1 in time, that is, eight hours after the apparatus 100 was turned on the first day, but, was slightly larger than the resistance RYm1, that is, the resistance RY of the primary transfer portion 40Y immediately after the apparatus 100 was turned on the previous day. This phenomenon indicates that some of the conductive substance(s) in the primary transfer roller 60Y and intermediary transfer belt 30, which had deviated returned to the original location; not all the conductive substance(s) did not return to the original location.

The resistance RY of the primary transfer portion 40Y immediately after (m10), one hour after (p10), and eight hours after (p10) the apparatus 100 was turned on the tenth day, were $3.2\times 10^7\Omega$, $2.5\times 10^7\Omega$, and $4.3\times 10^7\Omega$, respectively. The changes are attributable to the increases in the resistance of the primary transfer roller 60Y and intermediary transfer belt 30, which were caused by the deviation and/or deterioration of the conductive substance(s).

FIG. 8 shows the results of the transfer efficiency test in which the amount by which transfer current was flowed was changed right after (m1), one hour after (n1), and eight hours after (p1), the image forming apparatus 100 was turned on the first day. The amount of the transfer current, which corresponds to the highest transfer efficiency, is the optimal amount of transfer current for the resistance RY. FIG. 8 also shows the transfer efficiency test which corresponds to the resistance RYm10, that is, the resistance RY of the primary transfer portion 40Y immediately after the apparatus 100 was turned on the tenth day.

Referring to FIG. 8, as the resistance RY reduces (RYp1–RYm1–RYn1), the optimal value for the transfer current increases, whereas as the resistance RY increases (RYm1–RYm10), the optimal amount for the transfer current reduces. More specifically, as the electrical resistance of the primary transfer roller 60Y reduces, the electrical resistance of the primary transfer portion 40Y also reduces. Thus, as the primary transfer roller 60Y reduces in electrical resistance, the optimal amount for the transfer current increases. On the contrary, as the primary transfer roller 60Y decreases in electrical resistance, the optimal amount for the transfer current reduces. The changes which occurred to the optimal amounts for the transfer currents for the primary transferring portions 40M, 40C, and 40K due to the changes in the resistances RM, RC, and RK, respectively, are the similar to the above described one that occurred to the optimal amount for the transfer current for the primary transferring portion 40Y. Therefore, they will not be described here.

The reason why the optimal amount by which transfer current is to be flowed through the primary transfer portions 40Y, 40M, 40C, and 40K, that is, the target amounts for the transfer currents ItY, ItM, ItC, and ItK, are affected by the resistances RY, RM, RC, and RK is as follows:

Referring to FIG. 3, in the primary transfer portion 40Y, the transfer roller 60Y is in contact with the intermediary transfer belt 30, and the intermediary transfer belt 30 is in contact with the photosensitive drum 17Y. The amount by which transfer current flows through the primary transferring portion 40Y is the total amount of current which flows into the photosensitive drum 17Y from the transfer roller 60Y. However, this total amount of current includes the discharge current Iα which flows in the transfer nip, in which the abovementioned components are in contact with each other, and also, the discharge current other than the discharge current Iα. In terms of the direction in which the intermediary transfer belt 30 circularly moves, there are an upstream discharge current Iβ, that is, the discharge current which flows through the minutes gaps among the various components on the immediate upstream side of the transfer nip, and a downstream discharge current Iγ, that is, the discharge current which flows through the minute gaps on the immediate downstream side of the transfer nip.

As the transfer roller 60Y and intermediary transfer belt 30 reduce in electrical resistance, the area in which the transfer current flows upward and downward of the transfer nip along the intermediary transfer belt 30 increases in size. Further, as the transfer roller 60Y reduces in electrical resistance, the area in which the transfer current flows upstream and downstream of the transfer nip along the peripheral surface of the primary transfer roller 60Y increases in size. Therefore, the ratio by which the upstream and downstream discharge currents Iβ and Iγ occupy in the total amount of transfer current increases. Thus, if the transfer current is kept stable (constant) in the total amount, the portion of the transfer current, which flows through the transfer nip reduces.

However, the effective transfer current, that is, the portion of the transfer current, which actually contributes to toner image transfer, is the discharge current Iα, that is, the portion of the transfer current, which flows through the transfer nip. Therefore, in order to ensure that the amount of the discharge current Iα is optimal for toner image transfer, the total amount by which the current is flowed through the primary transfer portion 40Y, that is, the target amount for the transfer current ItY, must be increased. More specifically, if the resistance RY reduces by x %, the stable voltage applied to the primary transfer portion 40Y must be set to a value higher than (100–x)/100 which corresponds to the amount of the resistance of the primary transfer portion 40Y before the reduction. Otherwise, the discharge current Iα, that is, the portion of the overall transfer current, which flows through the transfer nip, will become insufficient, and therefore, unsatisfactory image transfer will occur.

On the other hand, as the transfer roller 60Y and intermediary transfer belt 30 increase in electrical resistance, a phenomenon opposite to the above described one occurs. That is, if the transfer current is kept stable (constant) in the total amount, the discharge current Iα, that is, the portion of the discharge current, which flows through the transfer nip, and therefore, actually contributes to toner image transfer, will become excessive. Therefore, the total amount by which current is flowed through the primary transfer portion 40Y must be decreased. More specifically, if the electrical resistance of the primary transfer portion 40Y increases by x %, the stable voltage to be applied to the primary transfer portion 40Y must be set to a value lower than (100+x)/100, that is, the value prior to the increase in the electrical resistance. Otherwise, the discharge current Iα, that is, the portion of the discharge current, which flows through the transfer nip, will become excessive, which results in the decrease in transfer efficiency.

Therefore, in order to ensure that a toner image is satisfactorily transferred, the target amount for the transfer currents ItY, ItM, ItC, and ItK must be set in response to the change in the electrical resistances RY, RM, RC, and RK, as shown in Table 1.

Based on the above described logic, the amount of the resistances RY, RM, RC, and RK of the primary transfer portions 40Y, 40M, 40C, and 40K are calculated using FIG. 6 and Equation (1). Then, the target for the amounts by which the transfer currents ItY, ItM, ItC, and ItK are to be flowed through the image area during an image forming operation are obtained from the calculated values of the resistances RY, RM, RC, and RK, and the values for the target values for the transfer current in Table 1.

The target value for the transfer current ItY, that is, the target value for the transfer current 30 minutes after the image forming apparatus 100 is turned on, is 100 μA (ItY=100 μA). Thereafter, the primary transfer voltage controlling portion 42Y, 42M, 42C, and 43K obtain from FIG. 6, the target amounts for the transfer voltages VtY, VtM, VtC, and VtK for the image area, which correspond to the target amounts for the transfer currents ItY, ItM, ItC, and ItK. During an image forming operation, the primary transfer voltage controlling portion 42Y, 42M, 42C, and 42K make the primary transfer voltage applying portions 43Y, 43M, 43C, and 43K output the transfer voltages so that the transfer voltages remain stable at the level obtained by subtracting the potential level Vd (absolute value) from the target levels for transfer voltages VtY, VtM, VtC, and VtK. During an image forming operation, the primary transfer voltage applying portions 43Y, 43M, 43C, and 43K apply transfer voltages to the image areas through the primary transfer rollers 60Y, 60M, 60C, and 60K, respectively, so that the transfer voltages remain stable at the preset levels. That is, the smaller the primary transfer roller 60Y, 60M, 60C, and 60K become, the greater the target amounts for the transfer currents ItY, ItM, ItC and ItK are made.

The transfer voltage VtY, that is, the transfer voltage 30 minutes after the image forming apparatus 100 was started, is 2,500 V (VtY=2,500 V). Thus, +2,000 V is applied to the primary transfer roller 60Y, because the potential level Vd of the photosensitive drum 17Y is −500 V.

With the employment of the above described control sequence for adjusting the transfer voltage, an optimal amount of electrical current is always flowed through the primary transfer portions 40Y, 40M, 40C, and 40K while the transfer voltage is kept stable at a preset level. Therefore, an optimal amount of transfer current always flows through the portion of the transfer nip, which corresponds to the portion of the image, which is made up of toner. Therefore, a toner image is always satisfactorily transferred from the peripheral surface of the photosensitive drum 17Y onto the intermediary transfer belt 30. When transferring (primary transfer) a toner image from the photosensitive drum 17Y onto the intermediary transfer belt 30, the target value for the transfer current for ATVC is adjusted in response to the change in the electrical resistance RY of the primary transfer portion 40Y. Therefore, the effective transfer current can always be flowed through the primary transfer portion 40Y by an optimal amount while keeping stable the transfer voltage. Therefore, the amount by which transfer current is flowed through the portion of the transfer nip, which corresponds to the portion of an image, which is covered with toner, is always optimal. Therefore, a toner image is always satisfactorily transferred from the photosensitive drum 17Y onto the intermediary transfer belt 30.

In comparison, in the case of the ATVC sequence disclosed in Japanese Laid-open Patent Application 2004-117920, the preset target amount itself for the transfer current deviates from the optimal value, due to the change in the electrical resistance of the primary transfer portion 40Y, even though the transfer current can be flowed by the exact preset amount through the portion of the transfer nip, which corresponds to the portion of an image, which is made up of toner. Therefore, the transfer current is not always flowed by the optimal amount through the abovementioned portion of the transfer nip. The change in the electrical resistance of the primary transfer portion 40Y includes the change in the resistances of the photosensitive drum 17Y, primary transfer roller 60Y, and intermediary transfer belt 30, and the change in the electrical resistance of the contact area attributable to the change in the nip shape, which is attributable to the change in shape of the primary transfer roller 60Y, which occurs with the lapse of time. The reason why the optimal amount by which the transfer current is to be flowed through the primary transfer portion 40Y changes due to the change in the electrical resistance of the primary transfer portion 40Y, that is, the change in the electrical resistance of the primary transfer roller 60Y, is the same as that given above.

Embodiment 2

Referring to FIG. 4, a secondary transferring apparatus 53 is made up of an outside secondary transfer roller 50 and an inside second transfer roller 51 (member for backing up intermediary transferring member), which are kept pressed against each other with an intermediary transferring member 30 (which is in the form of an endless belt) sandwiched between the two rollers, forming thereby a secondary transfer nip between the intermediary transferring member 30 and the outside secondary transfer roller 50 and intermediary transferring member 30. As a secondary transfer voltage applying portion 57 (electrical bias providing means) applies voltage (secondary transfer voltage) to the outside secondary transfer roller 50 (transferring member), the toner image(s) on the intermediary transfer belt 30 is transferred (secondary transfer) onto the recording medium 23 (transfer medium) on the intermediary transfer belt 30. Incidentally, the secondary transfer roller 51 is grounded.

For descriptive convenience, the nip formed by the outside secondary transfer roller 50, and the intermediary transfer belt 30 which is kept pressed upon the outside secondary transfer roller 50 by the inside secondary transfer roller 51, and the adjacencies of the nip, are together referred to as a secondary transferring portion 54.

A secondary transfer current reading portion 58 reads the amount of current, which flows through the secondary transferring portion 54, and informs a secondary transfer voltage controlling portion 59 of the measured amount of the current. The secondary transfer voltage applying portion 57 is under the control of the secondary transfer voltage controlling portion 59, and applies the secondary transfer voltage (bias), and the voltages V4, V5, and V6 for ATVC, to the outside secondary transfer roller 50. The secondary transfer voltage controlling portion 59 carries out the ATVC sequence by controlling the secondary transfer voltage applying portion 57, obtaining thereby a proper (optimal) level value for the secondary transfer voltage which is to be applied to the outside secondary transfer roller 50 during an actual image forming operation in which the secondary transfer voltage is kept stable at this optimal level.

The outside secondary transfer roller 50 is made up of an axle, and a single layer of sponge made up of urethane which contains ion-conductive substance(s). The sponge layer is 24 mm in diameter. The amount of the electrical resistance of the primary transfer roller 60Y has been adjusted by controlling the amount by which ion-conductive substance(s) is added to the urethane as the material for the spongy layer of the outside secondary transfer roller 50. The volumetric resistivity of the outside secondary transfer roller 50 is in a range of $1\times10^{8}$-$2\times10^{8}\Omega$. The intermediary transfer belt 30 is not laminar, and is formed of polyimide resin in which carbon particles have been dispersed. Its electrical resistance has been adjusted by adjusting the amount by which carbon particles are dispersed in the polyimide resin as the material for the intermediary transfer belt 30. The volumetric resistivity of the intermediary transfer belt 30 is in a range of $1\times10^{8}$-$1\times10^{9}\Omega$, and the surface resistivity of the intermediary transfer belt 30 is in a range of $1\times10^{11}$-$1\times10^{12}\Omega$.

In the case of the image forming apparatus 100 in this embodiment, the secondary transferring apparatus is controlled so that the voltage (secondary transfer voltage) applied to the outside secondary transfer roller 50 remains stable, in order to ensure that the current which flows through the portion of the secondary transfer nip, which corresponds to the image bearing area of the intermediary transfer belt 30, on which toner is present, remains stable, even if the ratio (image ratio in secondary transfer nip) between the portion of the intermediary transfer belt 30, on which toner is present, and the portion of the intermediary transfer belt 30, on which toner is not present, changes in the secondary transfer nip.

The image forming apparatus 100 is operated in the ATVC mode to calculate an optimal level at which the secondary transfer voltage (bias) is to be kept stable, in order to ensure that even if the outside secondary transfer roller 50 and intermediary transfer belt 30 change in the amount of electrical resistance, the amount by which secondary transfer current flows through the portion of the secondary transfer nip, which corresponds to the portion of the intermediary transfer belt 30, on which toner is present, always remains optimal. The outside secondary transfer roller 50 of the secondary transferring portion 54 and the intermediary transfer belt 30 change in the amount of resistance with the lapse of time.

The ATVC sequence carried out in the second embodiment is similar to the ATVC sequence carried out for the primary transferring portion 40Y (FIG. 3). The object of ATVC is to optimize the amount by which the current (secondary transfer current) flows through the secondary transferring portion 54 during an actual image forming operation. Thus, the ATVC sequence is carried out while the image forming apparatus 100 is not used for image formation. That is, it is carried out using the portion of the peripheral surface of the photosensitive drum 17Y, which is not being used for image formation.

First, the secondary transfer voltage controlling portion 59 makes the second transfer voltage applying portion 57 apply preset voltages V4, V5, and V6 for ATVC to the outside secondary transfer roller 50 while keeping the voltages stable. In this embodiment, V4=2,000 V; V5=3,500 V; and V6=5,000 V.

The second transfer current reading portion 58 reads the currents I4, I5, and I6 which flow while the voltages V4, V5, and V6 for ATVC are applied. Then, it transmits the measured amounts of the currents I4, I5, and I6 to the secondary transfer voltage controlling portion 59.

The secondary transfer voltage controlling portion 59 calculates the electrical resistance R2 of the secondary transferring portion 54 using Equation (2) given below:

$$R2=((V4/I4+V5/I5+V6/I6)/3 \quad (2).$$

The amounts of the currents I4, I5, and I5 for ATVC immediately after the image forming apparatus 100 was started up were: I4=20 μA; I5=30 μA; and I6=40 μA. Thus, from Equation (2);

$$\begin{aligned} R2 &= (2{,}000\,\mathrm{V}/20\,\mu A + 3{,}500\,\mathrm{V}/30\,\mu A + \\ &\quad 5{,}000\,\mathrm{V}/40\,\mu A)/3 \\ &= 1.14\times10^{8}\,\Omega. \end{aligned}$$

Table 2 shows the target values for the transfer current It2, that is, the optimal amounts, for the transfer current to be flowed through the secondary transferring portion 54. These values are stored in advance in the memory with which the second transfer voltage controlling portion 59 is provided. The values in Table 2, which are the optimal values for the amount by which current to be flowed through the secondary transferring portion 54, that is, the target amount for the transfer current It2, are calculated for each electrical resistance R2 of the secondary transferring portion 54, and were summarized in the form of a table. The values of the resistance R2, in Table 2, were obtained using Equation (2).

TABLE 2

| | R2 ($\times10^{8}\,\Omega$) | | | | | | | |
|---|---|---|---|---|---|---|---|---|
| | −1.0 | −1.5 | −2.0 | −2.5 | . . . | −4.0 | −4.5 | −5.0 |
| It2 | 38 | 35 | 32 | 30 | . . . | 24 | 22 | 20 (μA) |

The reason for adjusting the target amount for the second transfer current It2 in response to the change in the value of the resistance R2 of the secondary transferring portion 54 is that the optimal amount for the current to be flowed through the secondary transferring portion 54 is affected by the change in the resistance R2 of the second transferring portion 54. That is, as the outside secondary transfer roller 50 reduces in electrical resistance, the resistance R2 of the secondary transferring portion 54 also reduces. Thus, as the outside secondary transfer roller 50 reduces in resistance, the amount by which current flows through the outside secondary transfer roller 50 increases, whereas as the outside secondary transfer roller 50 increases in resistance, the amount by which current flows through the outside secondary transfer roller 50 decreases. This phenomenon, that is, this reason for the adjustment of the target amount for the second transfer current It2 is roughly the same as the reason why the target amount for the current ItY to be flowed through the primary transfer roller 60Y is adjusted in response to the change in the resistance of the primary transfer portion 40Y (resistance of primary transfer roller 60Y).

The reason why the optimal amount, that is, the target amount, for the current It2 to be flowed through the secondary transferring portion 54 is affected by the change in the resistance R2 of the secondary transferring portion 54 is as follow.

That is, not only the target amount for the transfer current It2 to be flowed through the secondary transferring portion 54 includes the amount for the discharge current which flows through the inside secondary transfer roller 51, intermediary transfer belt 30, recording medium 23, and outside secondary transfer roller 50, in the transfer nip, but also, the amount for the discharge current other than the discharge current in the transfer nip. More specifically, in terms of the direction in which the intermediary transfer belt 30 circularly moves, there are upstream and downstream discharge currents, that is, the discharge currents which flow through the minute gaps on the immediate upstream and downstream sides, respectively, of the interface between the intermediary transfer belt 30 and recording medium 23, in the second transfer nip. The target amount for the transfer current It2 includes these upstream and downstream discharge currents. Further, it also includes the discharge currents which flow through the portion of the secondary transfer nip, which correspond to the edge portions of the intermediary transfer belt 30 in terms of the thrust direction, and through which the recording medium 23 is not conveyed.

As the outside secondary transfer roller 50 and intermediary transfer belt 30 reduce in electrical resistance, not only does it become easier for the discharge current to flow through the secondary transfer nip, but also, through the immediate upstream and downstream the areas of the secondary transfer nip, and therefore, the areas through which the transfer current flows increases in size. Further, as the outside secondary transfer roller 50 reduces in electrical resistance, the area in which the transfer current flows upstream and downstream of the transfer nip along the peripheral surface of the outside secondary transfer roller 50 increases in size. Therefore, the ratio by which the upstream and downstream discharge currents occupy in the total amount of transfer current increases. Thus, if the total amount of transfer current is kept (remains) constant, the portion of the transfer current, which flows through the transfer nip reduces.

Further, as the outside secondary transfer roller 50 and intermediary transfer belt 30 reduce in electrical resistance, the amount of the current which flows through the portions of the secondary transfer nip, through which the recording medium 23 does not pass, that is, the portions of the secondary transfer nip, which correspond to the end portions of the intermediary transfer belt 30 in terms of the thrust direction, increases in the ratio by which it occupies in the total amount of the secondary transfer current. Thus, if the secondary transfer current is kept the same in total amount, the discharge current which flows through the secondary transfer nip reduces. The portion of the secondary transfer current, which contributes to the transfer of a toner image onto the recording medium 23 is only the discharge current which flows through the secondary transfer nip. Therefore, in order to ensure that discharge current flows through the secondary transfer nip by a sufficient amount, the target value for the secondary transfer current It2 must be increased.

On the other hand, as the outside secondary transfer roller 50 and intermediary transfer belt 30 increase in electrical resistance, a phenomenon opposite to the above described one occurs. That is, if the secondary transfer current remains the same in total amount, the discharge current which flows through the transfer nip, and therefore, actually contributes to the transfer of a toner image onto the recording medium 23, will become excessive. Therefore, in order to ensure that the discharge current flows through the secondary transfer nip by the optimal amount, the target value for the secondary transfer current It2 must be decreased.

Based on the above described chain of logic, the second transfer voltage controlling portion 59 calculates the target amount by which the transfer current It2 is to be flowed through the image area during an actual image forming operation, from the resistance R2 calculated with the use of Equation (2), and Table 2 which contains target values for secondary transfer current. The target value for the secondary transfer current It2 immediately after the image forming apparatus 100 was started up was 35 μA (It2=35 μA).

Thereafter, the secondary transfer voltage controlling portion 59 obtains the target value for the transfer voltage Vt2 for the image area, which corresponds to the target value for the transfer current It2. The target value for the transfer voltage Vt2 immediately after the image forming apparatus 100 was started up was 4,250 V (Vt2=4,250 V).

Then, the secondary transfer voltage controlling portion 59 adds the amount of the transfer voltage Vt which must be applied to compensate for the recording medium 23, to the amount of the transfer voltage, which corresponds to the target amount for the transfer current It2, obtaining thereby the target level at which the transfer voltage VtT is kept stable during an actual image forming operation. While the ATVC sequence is carried out, the image forming apparatus 100 is operated without conveying the recording medium 23 through the secondary transferring portion 54. Therefore, the target amount for the second transfer voltage for an actual image forming operation is compensated for the conveyance of the recording medium 23. The compensation voltage Vp for the standard paper for the image forming apparatus 100 is 500 V (Vp=500 V).

In an image forming operation, the secondary transfer voltage controlling portion 59 makes the second transfer voltage applying portion 57 to apply to the outside secondary transfer roller 50, the secondary transfer voltage (bias), while keeping the secondary transfer voltage stable at voltage VtT. Therefore, when the image forming apparatus 100 is used with the standard paper therefor, the voltage VtT is set to 4,750 V (VtT=4,750 V).

With the employment of the above described control sequence, the transfer current is always flowed by an optimal amount through the secondary transferring portion 54 by the secondary transfer voltage which is kept stable. More specifically, transfer current is flowed by an optimal amount through the portion of the secondary transfer nip, which corresponds to the portion of the intermediary transfer belt 30, on which toner is present. Therefore, a toner image is always satisfactory transferred from the intermediary transfer belt 30 onto the recording medium 23. During the secondary transfer, that is, when transferring a toner image from the intermediary transfer belt 30 onto the recording medium 23, the target value for the transfer current It2 for ATVC sequence is adjusted in response to the change in the resistance of the secondary transferring portion 54. That is, the smaller the resistance of the outside secondary transfer roller 50 becomes, the greater the target value for the transfer current It2 is rendered. Therefore, the secondary transfer current is always flowed by an optimal amount through the secondary transferring portion 54 while the secondary transfer voltage is kept stable. Therefore, the secondary transfer current is always flowed by an optimal amount through the portion of the secondary transfer nip, which corresponds to the portion of the intermediary transfer belt 30, on which toner is present. Therefore, a toner image is always satisfactory transferred from the intermediary transfer belt 30 onto the recording medium 23.

Embodiment 3

In the second embodiment, Table 2 was created so that the amount by which the transfer current is to be flowed in the ATVC sequence is optimized in response to the change in the resistance R2 of the secondary transferring portion 54. However, the amount by which transfer current flows through the secondary transferring portion 54 is also affected by the amount of toner charge per unit amount of toner, which is substantially affected by the change in the ambient condition. In this embodiment, therefore, the target value for the transfer current for the ATVC sequence is set in accordance with the resistance of the transferring portion and the change in the ambience so that an optimal amount of transfer current will flow through the transferring portion, as shown in Table 3.

TABLE 3

| | R2 ($\times 10^8$ Ω) | | | | | | | |
|---|---|---|---|---|---|---|---|---|
| | −1.0 | −1.5 | −2.0 | −2.5 | . . . | −4.0 | −4.5 | It2(μA) −5.0 |
| High | 58 | 54 | 50 | 47 | . . . | 40 | 38 | 36 |
| Mid. | 68 | 64 | 60 | 57 | . . . | 50 | 48 | 46 |
| Low | 75 | 70 | 65 | 62 | . . . | 55 | 53 | 50 |

In terms of the structure of the secondary transferring portion 54, the portion of the ATVC sequence, in which transfer current is measured while changing in three steps the transfer voltage, and the calculation of the amount of the resistance of the resistance R2 of the secondary transferring portion 54, the third embodiment is the same as the second embodiment. Incidentally, the definition of the "moisture content" in Table 3 is as follows: "low moisture content" means 1.94 g/kg; "middle moisture content" means 1.94-14.09 g/kg; and "high moisture content" means 14.09 g/kg. In other words, the greater the moisture content, the greater the target value for the amount by which the transfer current is to be flowed.

In the third embodiment, the absolute humidity in the image forming apparatus 100 is calculated by detecting the internal temperature and internal relative humidity of the image forming apparatus 100 with the use of a thermometer and a hygrometer 60 (humidity detecting means), which are placed in the image forming apparatus 100. Then, the amount (g/kgAIR) of moisture in the ambient air is obtained. The secondary transfer voltage controlling portion 59 obtains the target value for the amount by which the transfer current It2 to be flowed through the portion of the transfer nip, which corresponds to the image area, in an image forming operation, based on the calculated resistance R2 and the moisture content in the ambient air, referring to Table 2.

Thereafter, the secondary transfer voltage controlling portion 59 obtains the target value for the transfer voltage Vt2, which corresponds to the obtained target value for the transfer current It2. Then, it adds the voltage Vp for compensating for the presence of the recording medium 23 to the target value for the transfer voltage Vt2, obtaining thereby the voltage VtT at which the transfer voltage is kept constant. Then, the secondary transfer voltage controlling portion 59 causes the secondary transfer voltage applying portion 57 to apply second transfer voltage (bias) to the outside secondary transfer roller 50 while keeping the secondary transfer voltage constant at voltage level VtT.

Therefore, transfer current is always flowed by an optimal amount through the secondary transferring portion 54 by the transfer voltage which is kept constant. Therefore, even if toner changes in the amount of electrical charge it holds, the transfer current It2 is flowed by the optimal amount.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 316369/2006 filed Nov. 22, 2006, which is hereby incorporated by reference.

What is claimed is:

1. An image forming apparatus comprising:

an image bearing member for carrying a toner image;

a transfer member for cooperating with said image bearing member to form a nip to transfer a toner image from said image bearing member onto a transfer medium nipped by the nip;

transfer voltage applying means for applying a transfer voltage to said transfer member to transfer the toner image, the transfer voltage being constant-controlled at a target voltage level;

current detecting means for detecting a current when a monitor voltage is applied to said transfer member; and transfer voltage level determining means for determining the target voltage level from a target current and the current detected by said current detecting means, wherein the target current increases with decrease of a resistance of said transfer member.

2. An apparatus according to claim 1, further comprising:

water content detecting means for detecting a water content in the ambient air, wherein said transfer voltage level determining means increases the target current with a decrease in the water content detected by said water content detecting means.

3. An apparatus according to claim 1, wherein the transfer medium is an intermediary transfer member.

4. An apparatus according to claim 1, wherein the transfer medium is a recording material.

5. An image forming apparatus comprising:

an image bearing member for carrying a toner image;

a transfer member for cooperating with said image bearing member to form a nip to transfer a toner image from said image bearing member onto a transfer medium nipped by the nip;

transfer voltage applying means for applying a transfer voltage to said transfer member to transfer the toner image, the transfer voltage being constant-controlled at a target voltage level;

current detecting means for detecting a current when a monitor voltage is applied to said transfer member; and transfer voltage level determining means for determining the target voltage level from a target current and the current detected by said detecting means, wherein when a resistance of the transfer member is a first resistance, said transfer voltage level determining means determines the target voltage level on the basis of a first target current, and when the resistance of the transfer member is a second resistance which is larger than the first resistance, said transfer voltage level determining means determines the target voltage level on the basis of a second target current which is smaller than the first target current.

6. An apparatus according to claim 5, wherein an amount of an increase of the target current per a decrease in an amount of the resistance of the transfer member is large when the resistance is small.

7. An apparatus according to claim 5, wherein an amount of increase of the target current is larger when the resistance of the transfer member is equal to or less than $2\times10^8\Omega$ than when the amount of increase of the target current is more than $2\times10^8\Omega$.

8. An apparatus according to claim 5, wherein the resistance of the transfer material is determined as a quotient provided by dividing the monitor voltage applied to the transfer member by the current detected by said detecting means.

9. An image forming apparatus comprising:

an image bearing member for carrying a toner image;

a transfer member for cooperating with said image bearing member to form a nip to transfer a toner image from said image bearing member onto a transfer medium nipped by the nip;

transfer voltage applying means for applying a transfer voltage to said transfer member to transfer the toner image, wherein said transfer member voltage applying means may apply a plurality of preset monitor voltages to determine a target transfer voltage level;

current detecting means for detecting a plurality of currents when each of the plurality of preset monitor voltages are applied to said transfer member; and transfer voltage level determining means for determining a target transfer voltage level by (i) calculating a resistance based on the plurality of currents, detected by said current detecting means, when the plurality of preset transfer voltages are applied, (ii) setting a target transfer current based on the calculated resistance, and (iii) calculating the target transfer voltage level based on the target transfer current, wherein the target transfer current increases with a decrease in a resistance of said transfer member.

* * * * *